US007631369B2

(12) United States Patent
Geiwald et al.

(10) Patent No.: US 7,631,369 B2
(45) Date of Patent: Dec. 15, 2009

(54) PERFORMANCE UNDERWEAR

(75) Inventors: Paul Urban Geiwald, San Diego, CA (US); Martin Roesch, San Diego, CA (US)

(73) Assignee: Winds Enterprises, Inc., Del Mar, CA (US)

( * ) Notice: Subject to any disclaimer, the term of this patent is extended or adjusted under 35 U.S.C. 154(b) by 127 days.

(21) Appl. No.: 11/388,967

(22) Filed: Mar. 24, 2006

(65) Prior Publication Data

US 2007/0220660 A1 Sep. 27, 2007

(51) Int. Cl.
*A41B 9/02* (2006.01)

(52) U.S. Cl. ..... 2/403; 602/67; 2/400; 2/401

(58) Field of Classification Search ..... 2/400–405, 2/78.1, 109, 113, 238, 228, 67
See application file for complete search history.

(56) References Cited

U.S. PATENT DOCUMENTS

| | | | | |
|---|---|---|---|---|
| 2,471,348 A | | 5/1949 | Redmond | |
| 2,586,614 A | * | 2/1952 | Collini | 450/104 |
| 2,641,257 A | * | 6/1953 | Rutledge | 602/67 |
| 3,083,710 A | * | 4/1963 | Rauser | 602/67 |
| 3,088,121 A | | 5/1963 | Stedman et al. | |
| 3,322,120 A | | 5/1967 | Wyss et al. | |
| 3,566,879 A | * | 3/1971 | Braun | 450/117 |
| 3,599,640 A | * | 8/1971 | Larson | 604/394 |
| 4,067,068 A | * | 1/1978 | Bregstein et al. | 2/406 |
| 5,131,100 A | * | 7/1992 | Atwater et al. | 2/405 |
| 5,210,882 A | * | 5/1993 | Moretz et al. | 2/404 |
| 5,689,836 A | * | 11/1997 | Fee et al. | 2/465 |
| 6,023,789 A | * | 2/2000 | Wilson et al. | 2/228 |
| 6,074,274 A | * | 6/2000 | Pyatt et al. | 450/101 |
| 6,289,520 B1 | * | 9/2001 | Page | 2/403 |
| 6,662,378 B2 | * | 12/2003 | Vartanyan | 2/403 |
| 6,671,887 B1 | * | 1/2004 | Eligan et al. | 2/228 |
| 6,848,121 B1 | * | 2/2005 | Halid | 2/400 |
| 2004/0016043 A1 | | 1/2004 | Uno et al. | |
| 2005/0229293 A1 | * | 10/2005 | Miller | 2/403 |

* cited by examiner

*Primary Examiner*—Katherine Moran
*Assistant Examiner*—Richale L Quinn
(74) *Attorney, Agent, or Firm*—Christie, Paker & Hale, LLP

(57) ABSTRACT

An athletic supporter is provided having a stability anchor located between a groin portion and a back portion, which extend from the front and back, respectively, of a waistband. The stability anchor is formed of a non-stretch fabric and provides increased compression, supporting, cupping and lifting for the male athlete.

26 Claims, 4 Drawing Sheets

PERFORMANCE UNDERWEAR

FIELD OF THE INVENTION

The present invention generally relates to performance underwear. More particularly, the present invention is directed to athletic supporters for male athletes.

BACKGROUND

Athletic supporters are generally designed to provide a tight fitting compression, supporting, cupping and lifting function of the male athlete's genital area. Excessive movement of the male genital area during athletic activity is undesirable.

It is known to provide an athletic supporter having a tightly knit fabric in the groin area. However, over time, fabric stretches, decreasing the athletic supporter's ability to provide the function described above. Moreover, the fabric often becomes the most loose in the groin area as the fabric used therein is only anchored to a waistband. There is therefore a need for an athletic supporter which provides the needed function.

SUMMARY OF THE INVENTION

In accordance with one aspect of the present disclosure, an athletic supporter for supporting male genitals includes an elastic waistband, a material connecting a front of the waistband to a back of the waistband, the material having a lowest point between the front of the waistband and the back of the waistband, and a longitidunal axis extending in a direction from the front of the waistband to the lowest point and from the lowest point to the back of the waist band. The material includes a groin portion extending downward from the front of the waistband, a back portion extending downward from the back of the waistband, and a stability anchor. The stability anchor connects the groin portion to the back portion and is configured to extend from substantially the lowest point at a sufficient length along the longitudinal axis to cup the genitals.

In accordance with another aspect of the present disclosure, an athletic supporter includes a front portion including a groin portion and a back portion. The stability anchor is disposed below the groin portion. The stability anchor connects the front portion to the back portion along a longitudinal axis. A front part of the stability anchor adjacent the groin portion is wider than a middle portion of the stability anchor.

In accordance with another aspect of the present disclosure, an athletic supporter includes a front portion having a groin portion, a back portion and a stability anchor, which extends between the groin portion and the back portion. The stability anchor includes a curved front edge connected to a correspondingly curved edge of the groin portion.

In accordance with another aspect of the present disclosure, an athletic supporter includes a front portion having a groin portion, a back portion, and a stability anchor, which is disposed below the groin portion. The stability anchor connects the front portion to the back portion along a longitudinal axis. Additionally, the stability anchor has a length along the longitudinal axis. The length of the stability anchor is greater than a width of the stability anchor.

DETAILED DESCRIPTION OF THE INVENTION

Figure 1:
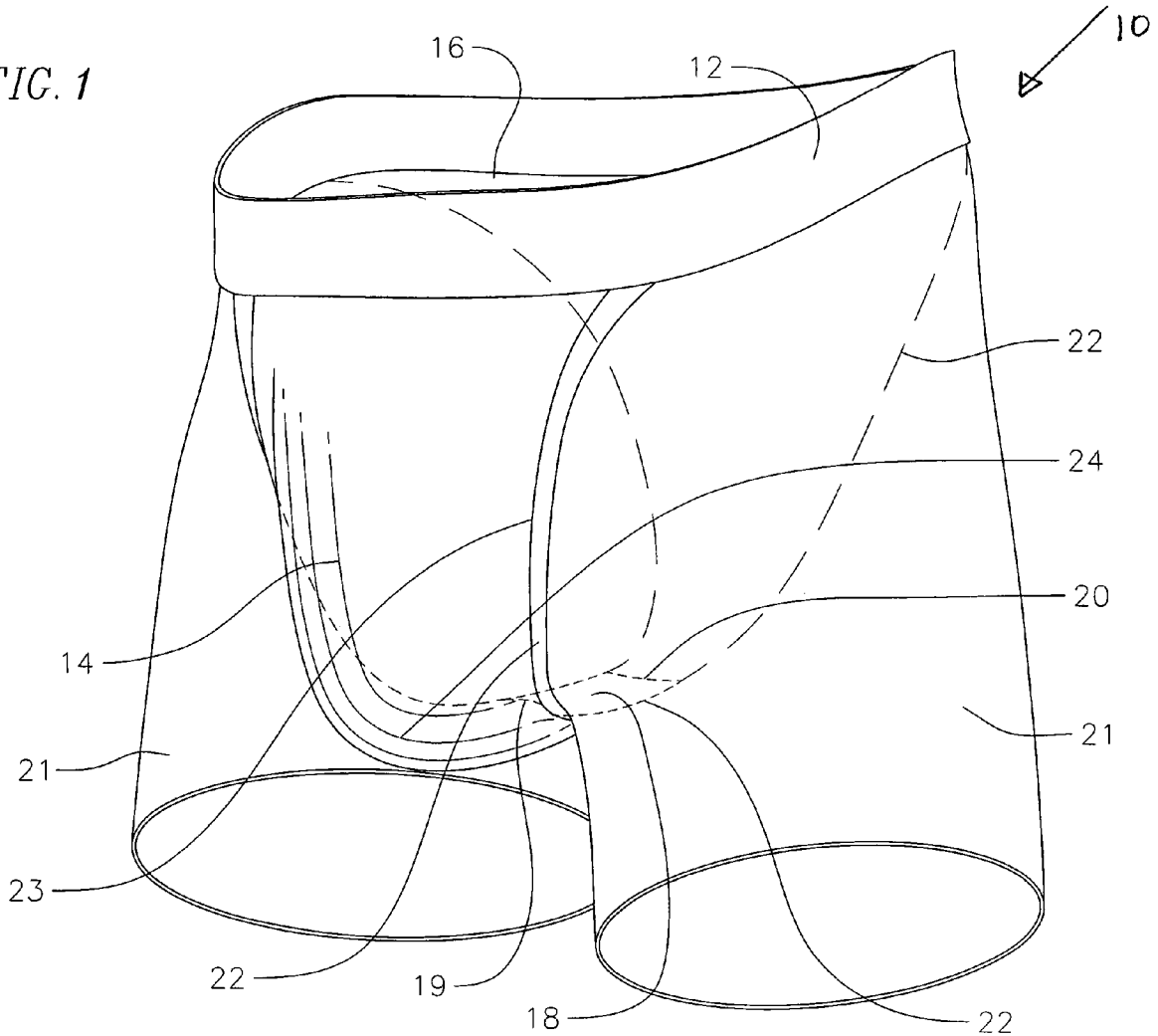
FIG. 1 is a perspective view of an athletic supporter according one embodiment of the present invention.
Figure 2:
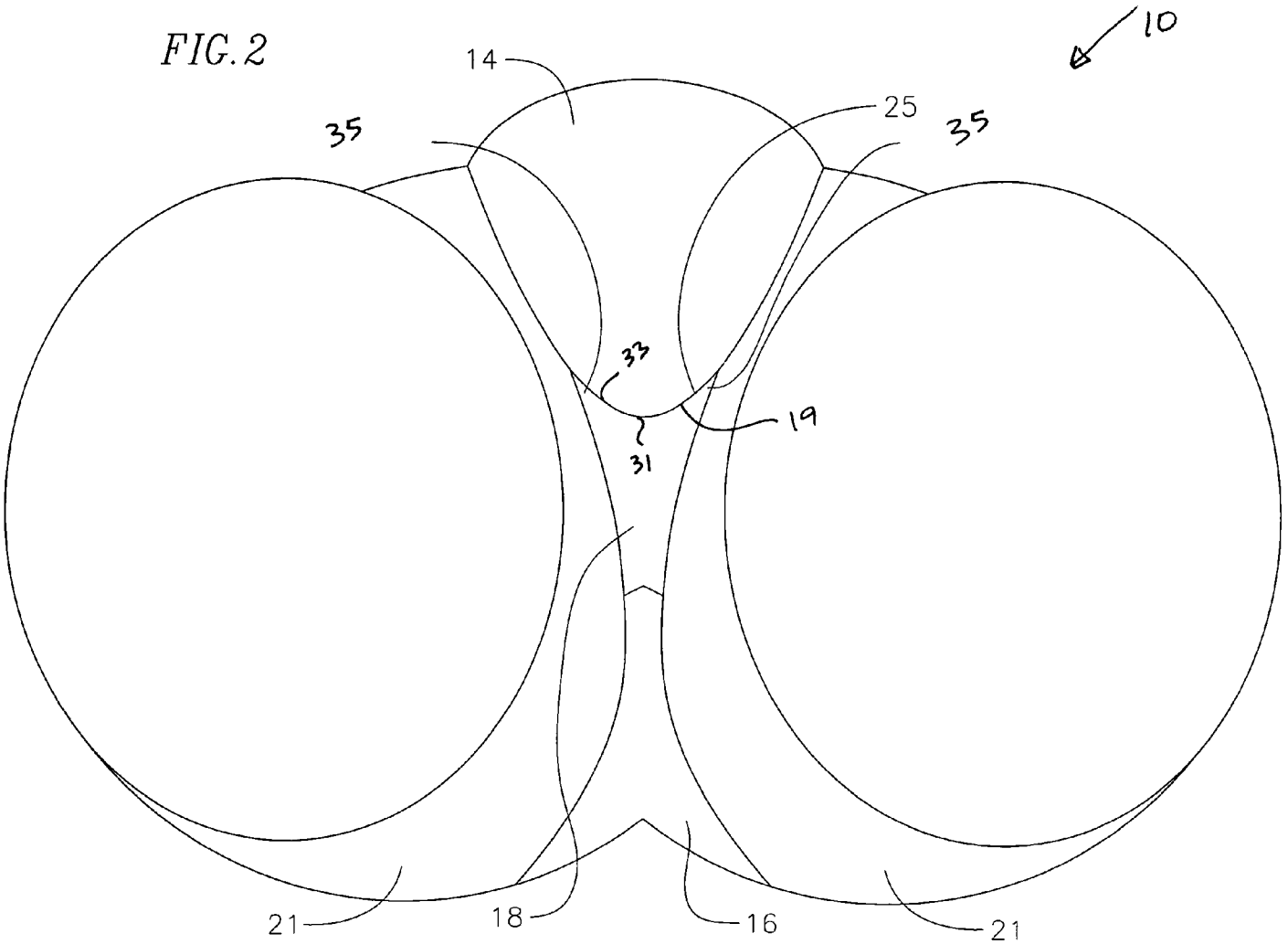
FIG. 2 is a bottom view of the athletic supporter.

FIGS. 1 and 2 show an athletic supporter 10 according to one embodiment of the present invention. A waistband 12 holds tight to an athlete's body (not shown) at the waist. A groin portion 14 extends downwardly from the waistband 12 at a front of the supporter 10. A back portion 16 extends downwardly from a back of the supporter 10. The back portion 16 may be sewn into the waistband 12 and extend generally downwardly therefrom. A stability anchor 18 connects the groin portion 14 to the back portion 16 to complete a line which supports the male athlete during supporter use, as described below. The stability anchor 18 may be stitched into the groin portion 14 along a front anchor seam 19 (shown in phantom) and into the back portion 16 along a back anchor seam 20 (also shown in phantom). Leg portions 21 extending downwardly from the waistband are also included. The leg portions 21 may be stitched into the groin portion 14, the stability anchor 18, and the back portion 16 along leg seams 22.

The groin and back portions 14, 16 on the one hand and the leg portions 21 on the other hand can be sewn to one another by any method known in the art. In a presently preferred embodiment, flat-lock seams formed from non-stretching thread, as known in the art, are used to form the leg seams 22.

The groin portion 14 includes a pouch portion 24 for receiving the male genitals during supporter use. The fabric of the groin portion 14 is arranged to form the pouch portion 24 having a low point 25 located below the stability anchor 18. The pouch portion 24 is located proximate to the stability anchor 18. The groin portion 14 can be constructed from any suitable material. In a preferred embodiment, the groin portion is constructed from elastic spandex yarn or cotton in a warp-knitted fabric.

Figure 3:
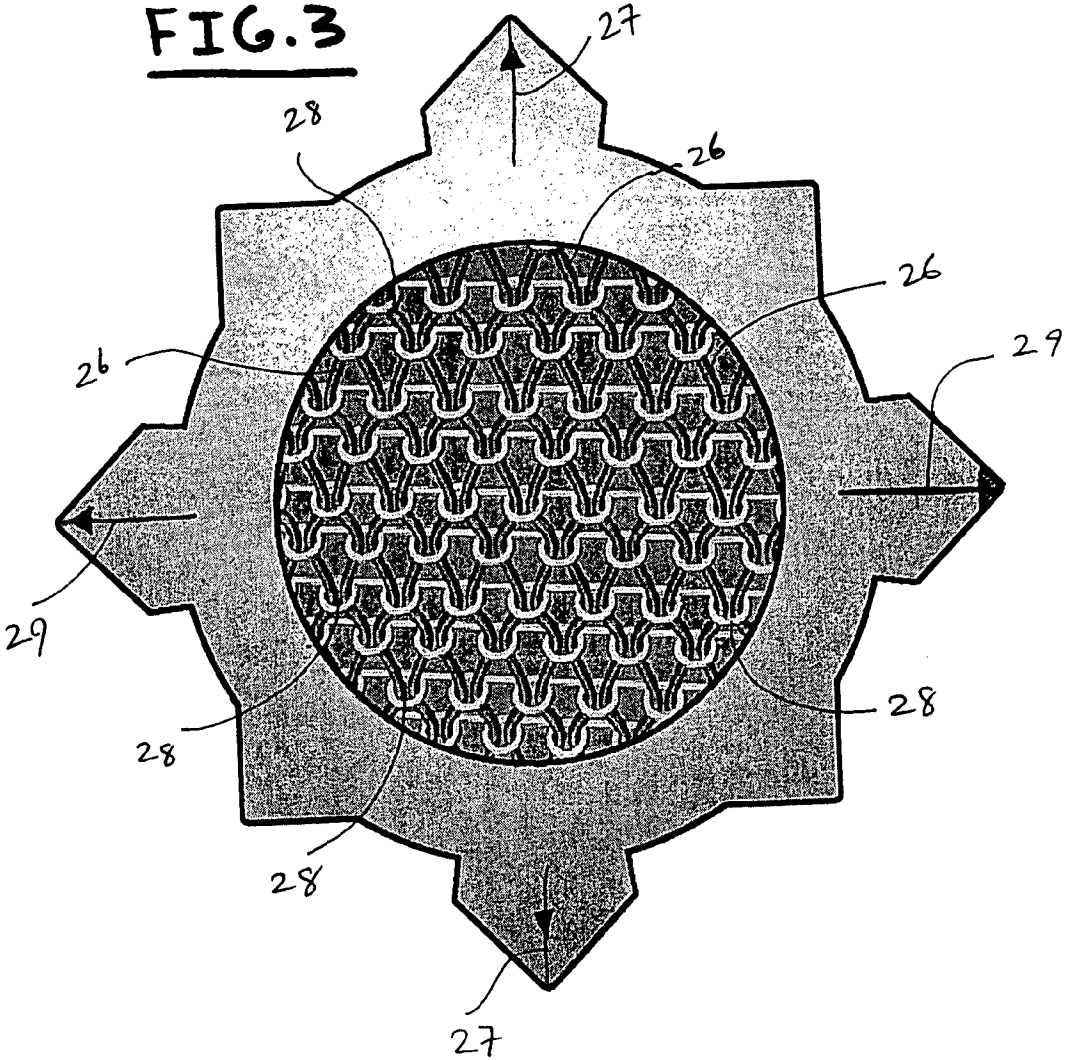
FIG. 3 is a close-up view of a warp knit fabric used to form the supporter of FIGS. 1 and 2.

With reference to FIG. 3, the warp knit is generally known in the art for having strands 26 running substantially parallel along a direction 27 of the fabric. Lateral threads 28 running substantially perpendicular to the strands 26 and in a direction 29 encircle sets of two strands 26 at once. Each adjacent lateral thread 28 encircles one of the two strands 26 in the first set and one of the two strands 26 from the second set. This pattern is repeated throughout. The warp knit, by virtue of having parallel strands 26 along the direction 27 of the fabric, is resistant to stretch in the direction 27 when compared to other knitted fabrics, which may undesirably stretch. Thus, the warp knit fabric stretches less along the direction 27 than along the direction 29.

With reference again to FIG. 1, as the male athlete's genitals exert pressure on the groin portion 14 during supporter use, the warp knit fabric constricts movement. The vertical strands 26 of the warp knit are placed to run from the waistband down the body of the male athlete in a line perpendicular to the waistband. Some of the vertical strands end in the leg seam, while others pass around the athlete's genitals and back up to the stability anchor 18, located behind the genitals against the athlete's body. The fabric provides the lifting function by lifting the genitals toward the waistband and higher than they would rest absent the supporter. The vertical strands also provide the cupping function by running flush against the genitals, and provide the compression function by pressing the genitals against the body.

The warp knit fabric used to form the groin portion 14 can stretch a relatively greater amount in the horizontal direction, roughly parallel to the waistband, than in the vertical direction. The ability to stretch in the horizontal direction allows for the accommodation of different sizes and shapes of male genitals. The groin portion stretches in the horizontal direction to accommodate the genitals of the supporter user while maintaining slight pressure on the genitals in the horizontal direction, thus aiding the cupping and compression functions of the supporter 10.

The back portion 16 and leg portions 20 can be formed with a circular knitted fabric and can be formed using cotton or elastic spandex yarn. Circular knitted fabrics are known in the art and generally are equally stretchable in every direction, allowing for a range of movement of the athlete's body in the regions covered by the back portion 16 and leg portions 20. The stretchability of the circular knit fabric against the body of the male athlete generally provides comfort and eases athletic movement during use.

The stability anchor 18 connects the groin portion 14 to the back portion 16 by extending from the groin portion 14 to the back portion 16 while laterally following the contour of the inner thigh portions of the leg portions 20 and being connected to the leg portions 20. In a preferred embodiment, the stability anchor 18 is formed of a non-stretch fabric. The stability anchor 18 may be in any shape desired as long as it extends from the groin portion 14 to the back portion 16 following the inner thigh portions of the leg portions 20 and can provide the structural support and stability functions described herein. In one example, as shown in FIGS. 1 and 2, the stability anchor has a curved front edge 31 which combines with a correspondingly curved edge 33 of the groin portion 14 to form the front anchor seam 19. The curved edge 31 facilitates the cupping function of the groin portion 14 about the groin area. During use of the supporter 10 by the male athlete, the stability anchor 18 sits against the body in the area directly behind the male genital area, with protrusions or projections 35 extending along either side of the male genital area. One of ordinary skill in the art will readily appreciate that the edge 31 may be straight but have the protrusions or projections 35 to extending along either side of the male genital area. However, the curved edge 31 evenly distributes the loads at portions near the anchor seam 19.

The stability anchor can be constructed in any shape. For example, the stability anchor 18 can be rectangular such that the length of the rectangle extends between the groin portion 14 and the back portion 16, and the width of the rectangle extends between opposing leg portions 20. As shown in FIGS. 1 and 2, however, the stability anchor 18 can be shaped to follow the contour of a person's body below the groin portion 14 adjacent the inner thighs and extending to the back portion 16. The stability anchor 18 that is shown in FIGS. 1 and 2 is wider adjacent the groin portion 14 and the back portion 16 than the portion between the leg portions 20. By extending from the groin portion 14 to the back portion 16, the stability anchor 18 prevents excessive movement of the groin portion 14 so that the groin portion 14 can perform the cupping and lifting function as described herein. Any attempted movement of the groin portion 14 from its position of cupping and lifting the genitals pulls on the stability anchor, which prevents such movement by being anchored to the back portion 16 and the leg portions 20. The stability anchor 18 provides a chassis-like function, by which the remaining portions of the athletic supporter are held together, and in particular, the cupping and lifting of the groin portion 14 is supported.

The groin portion 14 extends from the waistband 12, below stability anchor at the low point 25, and up again, where it is sewn into the stability anchor 18 along the concave curve 31. The leg seams 22 are designed to be placed against the male body and pass on either side of the male athlete's genitals before joining with the stability anchor 18 near the protrusions or projections 35. The pouch 25 (see FIG. 1), formed by groin portion 14 and defined at edges by the leg seams 22 and the front anchor seam 19, remains flush against the male athlete's genitals and facilitates the cupping function of the supporter 10.

Figure 4:
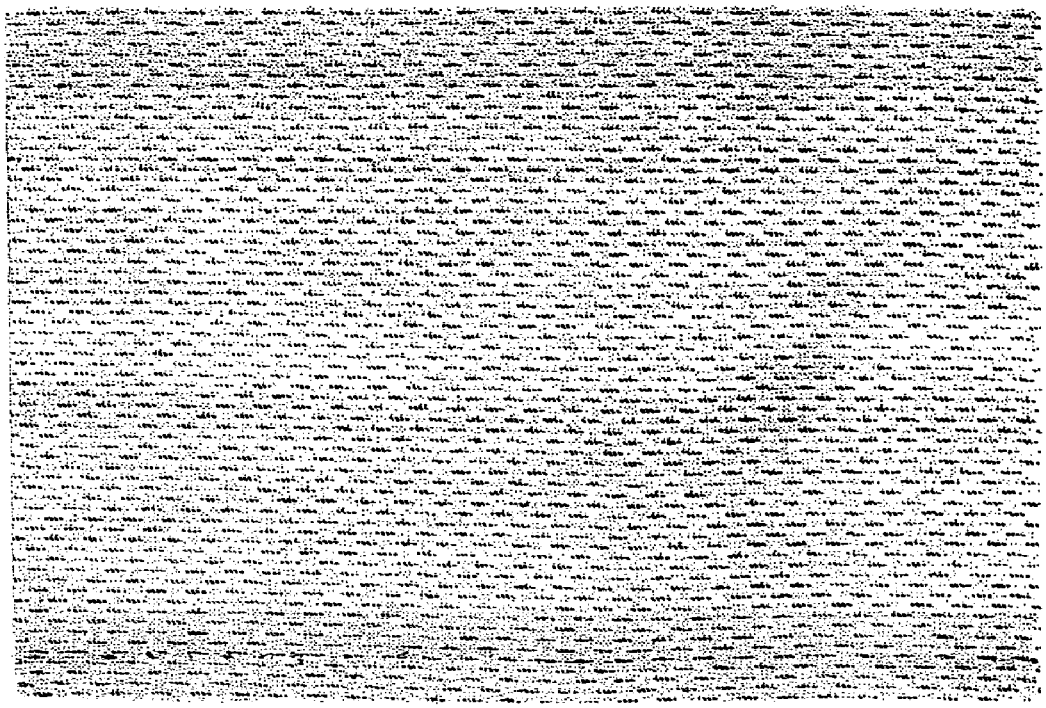
FIG. 4 is a close-up view of a waffle pattern fabric used to form the supporter of FIGS. 1 and 2.

The stability anchor 18 is formed of a non-stretch fabric such as polyester. The polyester is woven tightly according to methods known in the art. In a preferred embodiment, as shown in FIG. 4, the polyester may be woven into a waffle pattern along an outside surface and a flat pattern along an inside surface, according to methods also known in the art. Waffles of the waffle pattern may be staggered, oblong, and/or placed in the same direction. Generally, polyester is not stretchable. Fabric made with 100 percent polyester is stretchable according to the manner in which it is woven, and not according to the polyester threads. Polyester does not lengthen over time. The stability anchor 18, however, may be constructed from any fabric that is less stretchable than at least the groin portion 14.

Given the non-stretchable nature of polyester threads, stretchability of fabric formed from polyester is greatest in a direction perpendicular to two parallel threads having no interlocking cross thread therebetween. The oblong shape of the waffle pattern provides greater stretchability in a direction perpendicular to the oblong direction of the waffles 100. The direction parallel to the oblong direction of the waffles is non-stretchable, or much less stretchable than the fabric used to form other portions of the supporter.

The waffle pattern formed from polyester is also capable of wicking moisture from the body of the male athlete. Polyester does not generally absorb moisture. As moisture exits the athlete's body, it comes into contact with the flat inner surface of the stability anchor. The moisture dissipates along the threads of polyester, and then, due to gravity and/or the dissipation of the moisture along the polyester threads, the moisture exits along the waffled outer surface of the stability anchor. Upon exit to the outer surface, the moisture may evaporate. The waffle structure of the outer surface includes a larger surface area over which the moisture can evaporate than a flat surface. Air circulates along the outer surface of the fabric and into the waffles of the fabric, causing moisture at the outer surface to evaporate. As the moisture evaporates from the outer surface, more moisture is pulled from the inner to the outer surface of the fabric. This process serves to maintain the athlete's body dry as by preventing excess moisture from collecting on the body surface.

The stability anchor is placed such that the oblong direction of the waffles of the waffle pattern run from the front anchor seam 19 to the back anchor seam 20 of the supporter 10. This ensures minimal stretchability of the fabric in the direction from the front anchor seam 19 to the back anchor seam 20, described in greater detail below. The fabric of the stability anchor 18 is more stretchable in the direction from the one leg seam 22 to the other leg seam 22, allowing the fabric to stretch in this direction during supporter use. However, the stretching of the supporter due to the stretchability of the stability anchor in this direction is minimal as the distance from the one leg seam 22 to the other leg seam 22 is relatively small.

Over time, the fabric used to form the groin portion 14 and the back portion 16 may lengthen. The adverse effect of fabric lengthening is greatest in those areas furthest from any stable anchor, and least in those areas closest to any stable anchor.

The stable anchors are those components of the supporter 10 which do not lengthen over time or that lengthen less than the fabric used to form the portions of the supporter. The waistband 12, the stability anchor 18, and the leg seams 22 serve as stable anchors for the supporter 10. The fabric located furthest from any stable anchor can be stretched further along a line perpendicular to a plane defined by the fabric because of the stretching capability of the surrounding fabric. Fabric closer to a stable anchor cannot stretch as far in a line perpendicular to the plane defined by the fabric because the surrounding fabric (the stable anchor) does not have the same stretching capability.

During supporter use, the male genitals rest close to the stability anchor 18 and to the leg seams 22, both of which serve as stable anchors for the supporter 10. As the fabric of the groin portion 14 near the stability anchor 18 is less given to the adverse effects of fabric lengthening over time, the supporter 10 is better able to provide the supporter functions of cupping, compression, supporting and lifting than a supporter not incorporating the stable anchors discussed herein.

The stability anchor 18 decreases the amount of fabric lengthening over time along a line extending from the front of the waistband 12, through the legs of the male athlete, and to the back of the waistband 12. As the fabric used to form the front and back portions 14, 16 of the supporter 10 lengthens over time, the stability anchor 18 does not lengthen or only lengthens a negligible amount. The stability anchor 18, which forms part of the fabric along the line extending from the front of the waistband 12, through the legs of the male athlete, and to the back of the waistband 12, decreases the amount of fabric lengthening over time along this line compared to a fabric line made entirely of fabric used to form the portions of the supporter 10. Over time, the supporter 10 maintains a more flush fit against the male athlete's body than a supporter not having a stability anchor. The more flush fit facilitates the functions of the supporter 10 by cupping, lifting, and compressing the genitals.

Over time, due to the concentration of threading found in the stitching of the seams, the front and back portion seams 19, 20, as well as the leg seams 22, lengthen less than regular fabrics. Additionally, the flat-lock seams used in the leg seams 22 lengthen less than regular fabrics.

By attaching the stability anchor 18 at the leg seams 22, which are directly anchored to the waistband 12, the stability anchor 18 will better maintain over time its position along the line extending from the front of the waistband 12, through the legs of the male athlete, and to the back of the waistband 12. As a result, the stability anchor 18 will better remain flush against the male athlete's body in the area directly behind the genitals, thus facilitating the cupping, lifting, and compression functions of the supporter 10 over time better than a supporter not having a stability anchor and flat-lock seams.

The supporter 10 can take the form of a boxer, as shown in the embodiments of FIGS. 1 and 2, a brief, or a traditional jock strap. In boxer form, the leg portions extend down the legs of the male athlete, below the stability anchor 18 of the supporter 10. In brief form, the leg portions extend from the waistband down the legs to elastic bands which originate at the leg seams 22 and extend around the legs of the male athlete. Alternatively, the elastic bands of the brief form of the supporter extend around the leg portions themselves, apart from the leg seams 22.

In traditional jock strap form, leg portions are not used. The back portion of the supporter takes the form of two elastic straps which are sewn into the stability anchor 18 of the supporter 10 along the back anchor seam 20, and extend around the back of the male athlete and are secured to the waistband 12, occupying a similar position as the leg seams 22 of the embodiments shown in FIGS. 1 and 2.

While the invention has been described in its preferred embodiments, it is to be understood that the words which have been used are words of description and not of limitation. Therefore, changes may be made within the scope of the appended claims without departing from the true spirit and scope of the invention.

What is claimed is:

1. A garment for supporting male genitals, the garment comprising:

an elastic waistband;

material connecting a front of the waistband to a back of the waistband, the material having a longitudinal axis extending in a direction from the front of the waistband between legs of a wearer to the back of the waist band, the material comprising:

a groin portion made of a stretchable material, the groin portion extending downward from the front of the waistband and arranged to form a pouch portion to receive the male genitals when wearing the garment;

a back portion extending downward from the back of the waistband and arranged to receive the buttocks when wearing the garment; and a stability anchor connecting the groin portion to the back portion, wherein the stability anchor has a shorter length along the longitudinal axis than the groin portion and than the back portion;

wherein the stability anchor extends in the direction of the longitudinal axis and is attached to the groin portion by a front seam and is attached to the back portion by a separate back seam spaced from the front seam;

wherein the stability anchor extends below the back seam; and, wherein the stability anchor is made of a material that is less stretchable than the material of the groin portion in the direction of the longitudinal axis.

2. A garment according to claim 1, wherein the stability anchor comprises a concavely curved front edge connected to a correspondingly curved lower edge of the groin portion.

3. A garment according to claim 1, wherein the stability anchor is more stretchable in a direction perpendicular to the longitudinal axis than in a direction of the longitudinal axis.

4. A garment according to claim 1, wherein the stability anchor is stretchable in a direction perpendicular to the longitudinal axis.

5. A garment according to claim 1, wherein the groin portion is formed of a warp-knitted fabric.

6. A garment according to claim 1, wherein the stability anchor comprises a fabric having a waffle pattern.

7. A garment according to claim 1, further comprising leg portions extending from the elastic waistband to seams with the groin portion, the stability anchor, and the back portion.

8. A garment according to claim 1, wherein the material of the stability anchor is formed from polyester.

9. A garment for supporting male genitals, the garment comprising:

a front portion including a groin portion made of a stretchable material, the groin portion arranged to form a pouch to receive the male genitals during garment use;

a back portion; and a stability anchor connecting the front portion to the back portion along a longitudinal axis extending in a direction from the front portion between legs of a wearer to the back portion;

wherein a front part of the stability anchor adjacent the groin portion is wider than a middle portion of the stability anchor;

wherein the stability anchor is made of a material that is less stretchable than the material of the groin portion in the direction of the longitudinal axis.

10. A garment according to claim 9, wherein the front part of the stability anchor comprises a pair of spaced apart projections extending in the direction of the longitudinal axis.

11. A garment according to claim 9, wherein the stability anchor is more stretchable in a direction perpendicular to the longitudinal axis than in a direction of the longitudinal axis.

12. A garment according to claim 9, wherein the stability anchor is stretchable in a direction perpendicular to the longitudinal axis.

13. A garment according to claim 9, wherein the groin portion is formed of a warp-knitted fabric.

14. A garment according to claim 9, wherein the stability anchor is constructed from a fabric having a waffle pattern.

15. A garment according to claim 9, further comprising leg portions, the leg portions connected by seams to leg openings defined by the front portion, the back portion and the stability anchor.

16. A garment according to claim 9, wherein the material of the stability anchor is formed from polyester.

17. A garment for supporting male genitals, the garment comprising:

a front portion including a groin portion made of a stretchable material, the groin portion arranged to form a pouch to receive the male genitals during garment use;

a back portion; and a stability anchor connecting the front portion to the back portion along a longitudinal axis, extending in a direction from the front portion between legs of a wearer to the back portion;

wherein the stability anchor has a front edge connected to the groin portion, the front edge having a middle portion and a side portion on each side of the middle portion, the side portions projecting further into the front portion than the middle portion;

wherein the stability anchor is made of a material that is less stretchable than the material of the groin portion in the direction of the longitudinal axis.

18. A garment according to claim 17, wherein the front edge of the stability anchor is curved.

19. A garment according to claim 17, wherein the groin portion is formed of a warp-knitted fabric.

20. A garment according to claim 17, further comprising leg portions, the leg portions connected by seams to leg openings defined by the front portion, the back portion and the stability anchor.

21. A garment according to claim 17, wherein the material of the stability anchor is formed from polyester.

22. A garment for supporting male genitals, the garment comprising:

an elastic waistband;

a front portion including a groin portion made of a stretchable material, the groin portion extending downward from the front of the waistband and arranged to form a pouch to receive the male genitals during garment use;

a back portion extending downward from the back of the waistband and arranged to receive the buttocks during garment use; and a stability anchor connecting the front portion to the back portion along a longitudinal axis extending in a direction from the front portion between legs of a wearer to the back portion, the stability anchor having a length along the longitudinal axis;

wherein the length of the stability anchor is greater than a width of the stability anchor;

wherein the stability anchor has a shorter length along the longitudinal axis than the groin portion and than the back portion; and wherein the stability anchor is made of a material that is less stretchable than the material of the groin portion in the direction of the longitudinal axis.

23. A garment according to claim 22, wherein the stability anchor is more stretchable in a direction perpendicular to the longitudinal axis than in a direction of the longitudinal axis.

24. A garment according to claim 22, wherein the stability anchor is stretchable in a direction perpendicular to the longitudinal axis.

25. A garment according to claim 22, further comprising leg portions, the leg portions connected by seams to leg openings defined by the front portion, the back portion and the stability anchor.

26. A garment according to claim 22, wherein the material of the stability anchor is formed from polyester.

* * * * *

UNITED STATES PATENT AND TRADEMARK OFFICE

CERTIFICATE OF CORRECTION

PATENT NO. : 7,631,369 B2
APPLICATION NO. : 11/388967
DATED : December 15, 2009
INVENTOR(S) : Martin Roesch et al.

It is certified that error appears in the above-identified patent and that said Letters Patent is hereby corrected as shown below:

PATENT

On the Title Page

(74) Attorney, Agent, or Firm — Delete "Christie, Paker & Hale, LLP PTO
Insert -- Christie, Parker & Hale, LLP --

Signed and Sealed this

Twenty-second Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,631,369 B2
APPLICATION NO. : 11/388967
DATED : December 15, 2009
INVENTOR(S) : Geiwald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 174 days.

Signed and Sealed this

Twenty-first Day of December, 2010

David J. Kappos

David J. Kappos
*Director of the United States Patent and Trademark Office*